United States Patent [19]

Struthoff

[11] 4,213,051

[45] Jul. 15, 1980

[54] DUAL ACTING SLIT CONTROL MECHANISM

[76] Inventor: Robert A. Frosch, Administrator of the National Aeronautics and Space Administration with respect to an invention of Gustav L. Struthoff, Seal Beach, Calif.

[21] Appl. No.: 940,689

[22] Filed: Sep. 8, 1978

[51] Int. Cl.[2] ..... H01J 9/38; G21F 5/04

[52] U.S. Cl. ..... 250/457; 250/491; 250/513

[58] Field of Search ..... 250/513, 511, 512, 400, 250/442, 457, 281, 283

[56] References Cited

U.S. PATENT DOCUMENTS

| | | | |
|---|---|---|---|
| 3,603,787 | 9/1971 | Powers | 250/283 |
| 3,655,963 | 4/1972 | Brunnee | 250/511 |
| 3,778,621 | 12/1973 | Mikajiri | 250/442 |

*Primary Examiner*—Harold A. Dixon

*Attorney, Agent, or Firm*—Howard J. Osborn; John R. Manning

[57] ABSTRACT

A dual acting control system for mass spectrometers which permits adjustment of the collimating slit width and centering of the collimating slit while using only one vacuum penetration. Coaxial shafts, each with independent vacuum bellows are used to independently move the entire collimating assembly or to adjust the slit dimension through a parallelogram linkage.

8 Claims, 1 Drawing Figure

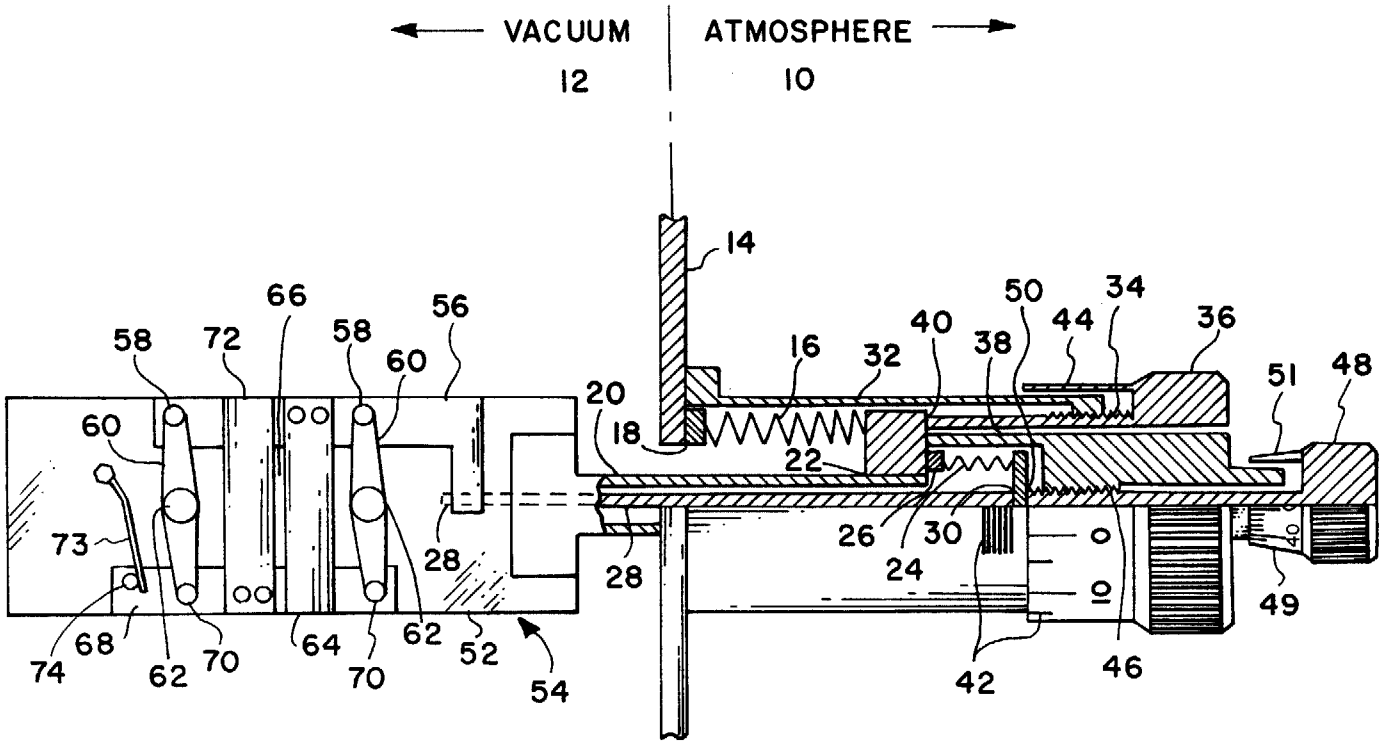
ATMOSPHERE
10
VACUUM
12
14
16
18
20
22
24
26
28
30
32
34
36
38
40
42
44
46
48
49
50
51
52
54
56
58
60
62
64
66
68
70
72
73
74

DUAL ACTING SLIT CONTROL MECHANISM

ORIGIN OF THE INVENTION

The invention described herein was made in the performance of work under a NASA contract and is subject to the provisions of Section 305 of the National Aeronautics and Space Act of 1958, Public Law 85-568 (72 Stat. 435; 42 USC 2457).

BACKGROUND OF THE INVENTION

This invention relates generally to mass spectrometer controls and more specifically to control of slit mechanisms of adjustable width. The invention may, however, be applied to other areas in which mechanical controls are required to penetrate a vacuum-tight barrier.

In the field of mass spectrometry, the collimator or adjustable slit mechanism is frequently used to limit the size of the ion beam. While several such mechanisms are available in the prior art, as shown in U.S. Pat. No. 2,964,998 by Middlestadt and U.S. Pat. No. 3,171,401 by Powell, all such prior art operates only to narrow or widen the slit dimension and none yields any adjustment for centering the slit position. Such adjustments are left to separate control mechanisms which by their nature, must then require separate vacuum penetrations. Since increasing the number of vacuum penetrations increases the risk of vacuum leaks, it is desirable to minimize such penetrations.

The present invention makes available a simple dual-acting control which both adjusts the slit dimension and moves the entire slit assembly for purposes of alignment with the ion beam. This is accomplished through a single vacuum penetration, thus minimizing the risk of vacuum leaks and highly simplifying vacuum maintenance.

SUMMARY OF THE INVENTION

The invention is a dual-acting, vacuum penetrating control apparatus. It is essentially two coaxial shafts each with a separate micrometer control outside the vacuum and with a vacuum bellows at the vacuum penetration to accommodate axial motion. The outer shaft and micrometer move the entire collimator assembly relative to the wall of the vacuum chamber. The inner shaft and micrometer knob are carried along by the motion of the outer shaft and themselves provide axial motion relative to the rest of the collimator assembly. This motion actuates a parallelogram linkage within the collimator assembly which in turn adjusts the slit dimension independently of the motion of the collimator assembly. The two shafts thus yield independent control of the opening and closing of the slits and of the lateral motion of the entire slit.

BRIEF DESCRIPTION OF THE DRAWING

The FIGURE is a simplified partial cross section of the invention showing the vacuum penetration.

DETAILED DESCRIPTION OF THE INVENTION

The basic concept of the invention is illustrated in the FIGURE where atmospheric pressure environment 10 is isolated from the vacuum environment 12 by vacuum barrier 14 and in which all parts shown in cross section are essentially cylinders. Outer bellows 16 is attached to vacuum barrier 14 by conventional vacuum seal means such as welding, brazing or clamping at the circumference of the penetration of the barrier by vacuum seal 18. Outer shaft 20 is similarly attached to outer bellows 16 at vacuum seal 22. Outer bellows 16 is a conventional vacuum bellows which permits outer shaft 20 to move axial without involving a sliding joint that requires vacuum integrity. Inner bellows 24 is attached to outer bellows 16 at vacuum seal 26 and inner shaft 28 is connected to inner bellows 24 at connection point 30, both by conventional sealing techniques. Because of the spring action of the bellows, the configuration then has the characteristic that compression or expansion of outer bellows 16 will move both shaft 20 and inner shaft 28 laterally, while compression or expansion of inner bellows 24 will cause lateral movement of only inner shaft 28.

The preferred embodiment of the invention shown in the FIGURE depicts one method of independent compression of the two bellows. In the FIGURE, outer fixed member 32 is rigidly attached to vacuum barrier 14 and mates at outer threads 34 with outer knob assembly 36. Rotation of outer knob assembly 36 causes it to traverse axially relative to fixed member 32 and relative to vacuum barrier 14. Outer knob assembly 36 thus exerts force upon outer bellows 16 at bearing point 40 and thus compresses outer bellows 16 relative to vacuum barrier 14 and moves outer shaft 20 axially. The extent of the axial motion is measured by the vernier scale markings 42 upon outer scale member 44 and fixed member 32.

Floating member 38 is rigidly attached to outer bellows 16 at the point remote from vacuum barrier 14 and is provided with inner threads 46 which mate with inner knob assembly 48. When rotated, inner knob assembly 48 traverses axially relative to floating member 38 and relative to outer shaft 20 compressing inner bellows 24 by acting at bearing point 50. Inner shaft 28, which is rigidly attached to inner bellows 24 at connection point 30 thus moves relative to outer shaft 20. The relative displacement is indicated by marking 49 on inner scale member 51.

Inside the vacuum environment 12 the independent motion of the shafts produces the desired collimating adjustments. Outer shaft 20 is rigidly connected to collimator frame 52, thus causing lateral movement of the entire collimator assembly 54 which follows axial movement of outer shaft 20. Movement of inner shaft 28 relative to outer shaft 20 causes actuator plate 56, which is rigidly connected to inner shaft 28, to slide within collimator frame 52, retained in place by actuator pins 58 and pivot arms 60, which rotate about pivot pins 62 fixed to collimator frame 52. As actuator plate 56 moves laterally, first slit plate 64, rigidly attached to it, moves with it, forming one edge of collimator slit 66. The other ends of pivot arms 60, attached to follower plate 68 by follower pins 70, cause follower plate 68 to move oppositely from actuator plate 56. Follower plate 68 carries with it second slit plate 72 which moves toward first slit plate 68 causing the dimension of slit 66 to be reduced.

Pin 74 is soldered or otherwise attached to follower plate 68. Spring 73 is anchored to collimator frame 54 and presses against pin 74 and keeps follower plate 68 springloaded to prevent backlash of slit plate 72.

Rotating inner knob 48 outside the vacuum thereby ultimately causes the adjustment of the width of collimator slit 66 within the vacuum, while rotating outer knob 36 causes the lateral movement of the entire slit within the vacuum.

It is to be understood that the form of the invention herein shown is merely a preferred embodiment. Various changes may be made in size, shape and arrangement of parts; equivalent means may be substituted for those illustrated and described; and certain features may be used independently from others without departing from the spirit and scope of the invention as defined in the following claims.

What is claimed as new and desired to be secured by Letters Patent of the United States is:

1. An apparatus for control of two independent mechanisms within a vacuum environment comprising:
   - a vacuum chamber;
   - a single opening defined in said vacuum chamber;
   - at least two shafts carried by said vacuum chamber and having portions thereof projecting into said chamber through said single opening;
   - means for moving each of said shafts independently relative to said vacuum chamber and relative to each other;
   - a collinator frame means of a mass spectrometer within said vacuum chamber attached to and operated by the first of said shafts;
   - slit adjustment means of a mass spectrometer within said vacuum chamber attached to and operated by the second of said shafts; and
   - vacuum seal means joining the shafts to the vacuum chamber for maintaining the vacuum integrity of the chamber.

2. An apparatus for control of two independent mechanisms as in claim 1 wherein the slit adjustment means comprises:
   - actuator plate means rigidly attached to said second shaft and moved by said second shaft;
   - first slit plate means rigidly attached to said actuator plate means and forming the first side of a collimator slit;
   - at least two actuator pin means attached to and moving with said actuator plate means;
   - at least two parallel pivot arm means, pivoting on pivot pins attached to said collimator frame and driven by said actuator pin means at first holes mating with said actuator pin means and containing second holes at the end opposite from said actuator pin means;
   - follower plate means to which are attached at least two follower pin means which mate with said second holes in said pivot arm means and which is thereby driven by said pivot arm means in a lateral direction opposite from the motion of said actuator plate means; and
   - second slit plate means rigidly attached to said follower plate means and forming the second side of the collimator slit, which has equal and opposite motion to said first side of the collimator slit when said second shaft moves laterally.

3. An apparatus for control of a mass spectrometer slit mechanism as in claim 2 wherein tension means is applied to said second slit plate means to prevent backlash thereof.

4. An apparatus for control of a mass spectrometer slit mechanism as in claim 2 wherein said tension means is a spring bearing against said follower plate means in a manner tending to separate said first and second slit plate means.

5. An apparatus for control of two independent mechanisms within a vacuum environment comprising:
   - a vacuum chamber;
   - a single opening defined in said vacuum chamber;
   - at least two shafts carried by said vacuum chamber and having portions thereof projecting into said chamber through said single opening;
   - means for moving each of said shafts independently relative to said vacuum chamber and relative to each other;
   - a first mechanism within said vacuum chamber attached to and operated by the first of said shafts;
   - a second mechanism within said vacuum chamber attached to and operated by the second of said shafts; and
   - vacuum seal means including a first vacuum bellows sealed to said first shaft and a second vacuum bellows sealed to said second shaft.

6. Apparatus for control of two independent mechanisms within a vacuum environment as in claim 5 wherein the means for moving the shafts independently is a first compression means attached to said first vacuum bellows and a second compression means attached to said second vacuum bellows.

7. An apparatus for control of two independent mechanisms as in claim 6 wherein the first compression means comprises:
   - a first outer cylindrical member rigidly mounted upon the vacuum chamber and containing a section of threads on an inner cylindrical surface; and
   - an outer knob assembly of cylindrical configuration axially aligned with and of approximately the radius of said first bellows vacuum seal and with threads on an outer cylindrical surface mating with the threads on said fixed outer cylindrical member which when rotated thereby traverses axially relative to said fixed outer cylindrical member and relative to the vacuum chamber and thus compresses said first bellows vacuum seal.

8. An apparatus for control of a mass spectrometer slit mechanism as in claim 6 wherein the second compression means comprises:
   - a floating inner cylindrical member rigidly mounted upon said first bellows vacuum seal at the end most remote from the vacuum chamber and containing a section of threads on a inner cylindrical surface; and
   - an inner knob assembly of cylindrical configuration axially aligned with, and of approximately the radius of, said second bellows vacuum seal and with threads on an outer cylindrical surface mating with the threads on said floating inner cylindrical member which when rotated thereby traverses axially relative to said first bellows vacuum seal and thereby compresses said second bellows vacuum seal.

* * * * *